US006775952B2

(12) United States Patent
Boxall et al.

(10) Patent No.: US 6,775,952 B2
(45) Date of Patent: Aug. 17, 2004

(54) SYSTEM OF PROTECTING THE EDGES OF CAST-IN-PLACE CONCRETE SLAB ON GROUND, CONSTRUCTION JOINTS

(75) Inventors: Russell Boxall, Matthews, NC (US); Nigel A. Parkes, Tucker, GA (US); Patrick Harrison, Priarie Village, KS (US)

(73) Assignee: Permaban North America, Inc., Tucker, GA (US)

( * ) Notice: Subject to any disclaimer, the term of this patent is extended or adjusted under 35 U.S.C. 154(b) by 0 days.

(21) Appl. No.: 10/210,464

(22) Filed: Jul. 31, 2002

(65) Prior Publication Data

US 2003/0033778 A1 Feb. 20, 2003

Related U.S. Application Data

(60) Provisional application No. 60/309,397, filed on Aug. 1, 2001.

(51) Int. Cl.[7] ..... E04B 1/68; E01C 11/06

(52) U.S. Cl. ..... 52/396.05; 52/742.14; 404/48; 404/74; 404/87; 404/88

(58) Field of Search ..... 52/396.62, 396.04, 52/742.14, 396.05; 404/47, 48, 74, 87, 88; 249/9, 98

(56) References Cited

PUBLICATIONS

ACI Committee 306 Technical Manual, 30 pgs. 1997.

*Primary Examiner*—Robert Canfield
(74) *Attorney, Agent, or Firm*—Banner & Witcoff, Ltd.

(57) ABSTRACT

An improved joint edge assembly, of the type used in the construction of concrete slabs, is disclosed. The assembly comprises a longitudinal joint rail, preferably of steel, which is supported off the ground by temporary formwork. The joint rail is secured to the formwork by mounting brackets. The joint rail comprises first and second joint edge members that are connected to each other by connectors with self-release elements. A plurality of studs extends downward and outward from each of the joint edge members into the concrete slabs provide a positive mechanical connection between the slab and the joint rail. As the concrete shrinks during hardening, the self-release elements of the connectors allow the joint to freely open. The joint edge assembly thus provides a self-releasing expandable joint between adjacent slab sections, and protects the edges of the adjacent slab sections from damage. A dowel aligner may also be integrated into the assembly, to allow proper positioning of dowels within the slab.

16 Claims, 2 Drawing Sheets

FIG.1
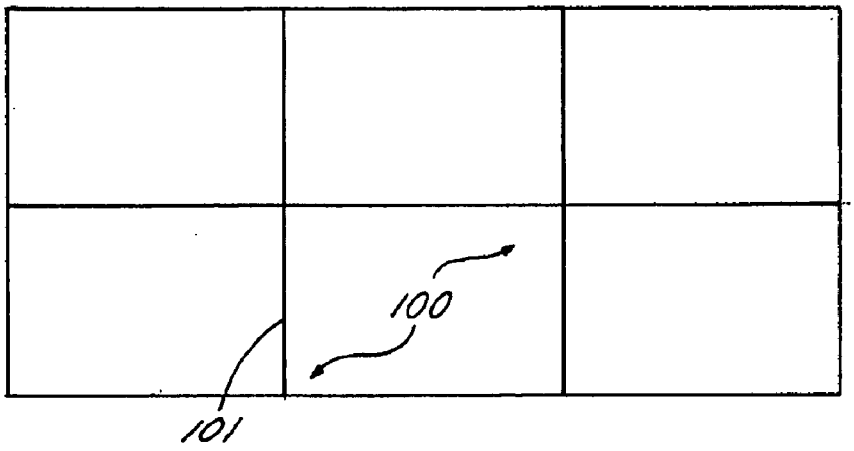
FIG.3
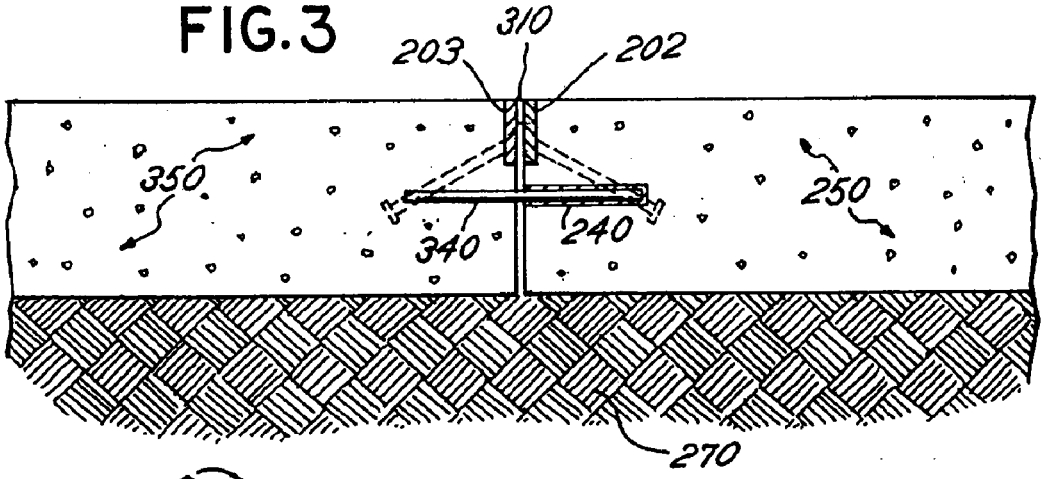
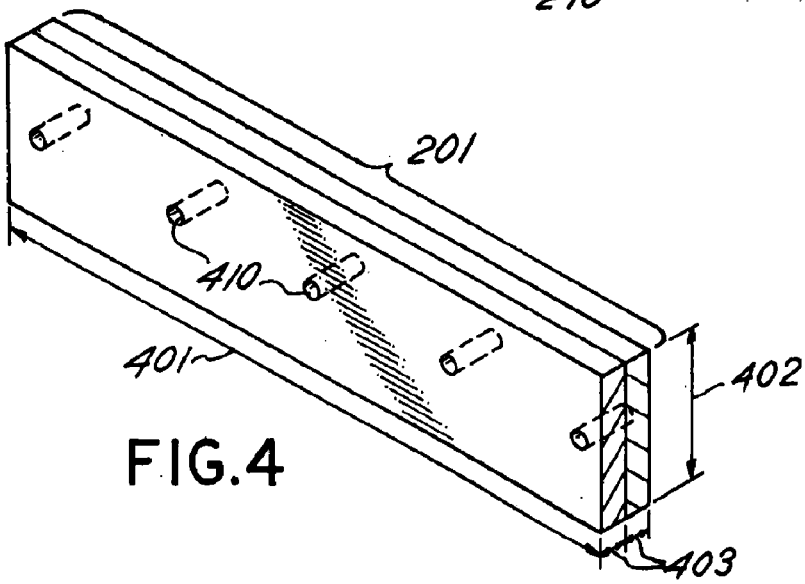
FIG.4

SYSTEM OF PROTECTING THE EDGES OF CAST-IN-PLACE CONCRETE SLAB ON GROUND, CONSTRUCTION JOINTS

CROSS REFERENCE TO RELATED APPLICATIONS

This application is based on, and claims the benefit of, co-pending U.S. Provisional Application Ser. No. 60/309,397, filed on Aug. 1, 2001, entitled "System of Protecting the Edges of Cast in Place Concrete Slab on Ground, Construction Joints," and incorporated herein by reference.

BACKGROUND OF THE INVENTION

1. Field of the Invention

This invention relates generally to the construction of concrete slabs. More particularly, the invention relates to an improved joint edge assembly that protects the joint edges and allows the joint to self-open as the concrete shrinks during hardening.

2. Related Art

For logistical and technical reasons, concrete floor slabs are made up of a series of individual blocks. The interface where one block meets another is termed a joint. Freshly placed concrete shrinks considerably as it hardens as the chemical reaction between the cement and the water occurs, i.e., hydration. As the concrete shrinks, tensile stress accumulates in the concrete, therefore, the joints should be free to open and thus allow shrinkage to occur without damaging the slab.

The joint openings, however, create discontinuities in the slab surface, which can cause the wheels of forklift trucks and other vehicles to impact the joint edges and chip small pieces of concrete from the edge of each slab. This damage to the edges of slabs is commonly referred to as "joint spalling." Joint spalling often interrupts the normal working operations of many facilities by slowing down forklift and other truck traffic, and/or causing damage to trucks and the carried products. Severe joint spalling can even cause loaded forklift trucks to be overturned and can be dangerous to employees. Furthermore, joint spalling can be very expensive to repair.

For these reasons, it is advantageous to protect the joint edges against spalling with steel bars or angles. Commonly used details illustrating the use of hot rolled steel bars (or angles) are shown in the American Concrete Industry (ACI) technical manuals 302 and 360. However, the standard installation procedure for these steel bars or angles is both time-consuming and expensive. The conventional procedures typically includes the following steps: (1) a temporary edge form is erected; (2) the first bar (or angle) is attached to the edge form; (3) the first concrete slab is cast; (4) the form is removed; (5) the second bar (or angle) is tack welded to the first; (6) the second concrete slab is cast; and (7) the tack welds are removed by grinding. Importantly, the quality control of the tack welding and the timing of the tack weld grinding are critical to the joint performance. If a weld is not completely removed by grinding, or if grinding is not completed shortly after the second slab is cast, then the joint remains locked together and tensile stress accumulates in the slabs, which often leads to unacceptable slab cracking.

For at least the foregoing reasons, an improved joint edge assembly that protects the joint edges of the concrete slab, and allows the joint to self-open as the concrete shrinks during hardening would be desirable.

SUMMARY OF THE INVENTION

The invention is an improved joint edge assembly that protects the joint edges of concrete slabs and allows the joint to self-open as the concrete shrinks during hardening. The apparatus comprises a longitudinal joint rail, made up of two elongated joint edge members. The elongated joint edge members are typically steel bar sections, but can be any similar suitable material. The sections are connected to one another along their length by two sets of connectors. The first set secures the sections during shipping and placement, and are removed before pouring the adjacent concrete slab. The second set of connectors remain throughout the concrete pouring operation and include release elements that self-release the joint edge members from each other under the force of the slabs shrinking during hardening, thus allowing the joint to open. The joint rail is supported above the ground surface by a mounting bracket attached to temporary formwork seated on the ground surface. A plurality of studs extend from the elongated joint edge members into the region where the slab is to be poured such that, upon hardening of the concrete slab, the studs are integrally cast within the body of the slab. One or more dowel aligners may be integrated into the form assembly to allow dowels to be accurately positioned within the adjacent slab sections. Alternatively, a base and sleeve may be used where a load plate is employed between adjacent slabs rather than dowels.

When the first of the adjacent slab sections is poured, the claimed form assembly restrains the wet concrete. Preferably, studs extending from the longitudinal joint rail become embedded in the concrete slab, providing a positive mechanical connection between the slab and the form assembly when the concrete hardens. Before pouring the adjacent slab, the connectors used to secure the longitudinal joint rail during shipping and placement are removed such that the connectors containing the self-release elements remain. This step is best taken after the concrete has hardened sufficiently to support the longitudinal joint rail. Further, at this point the dowels or load plates are placed, if desired, using the aligners that were cast into the first concrete slab. After pouring the adjacent slab, the studs extending from the longitudinal joint rail into the adjacent slab region become embedded in the adjacent concrete slab, providing a positive mechanical connection between the adjacent slab and the form assembly. As the chemical reaction between the cement and the water occurs, i.e., hydration, the concrete hardens and shrinks. As the slabs shrink away from one another, the self-release elements allow the elongated joint edge members to separate from one another. If desired, the gap formed by the separated joint edge members may be filled with a sealant.

BRIEF DESCRIPTION OF THE DRAWING

FIG. 1 of the drawing is a plan view of concrete slab with joints at the interface of the individual blocks.

FIG. 3 is a cross section of the completed joint edge constructed in accordance with the present invention showing the placement of the dowels between concrete slabs.

FIG. 4 is a perspective view of the joint rail in the present invention.

DETAILED DESCRIPTION OF THE PREFERRED EMBODIMENT

Figure 2:
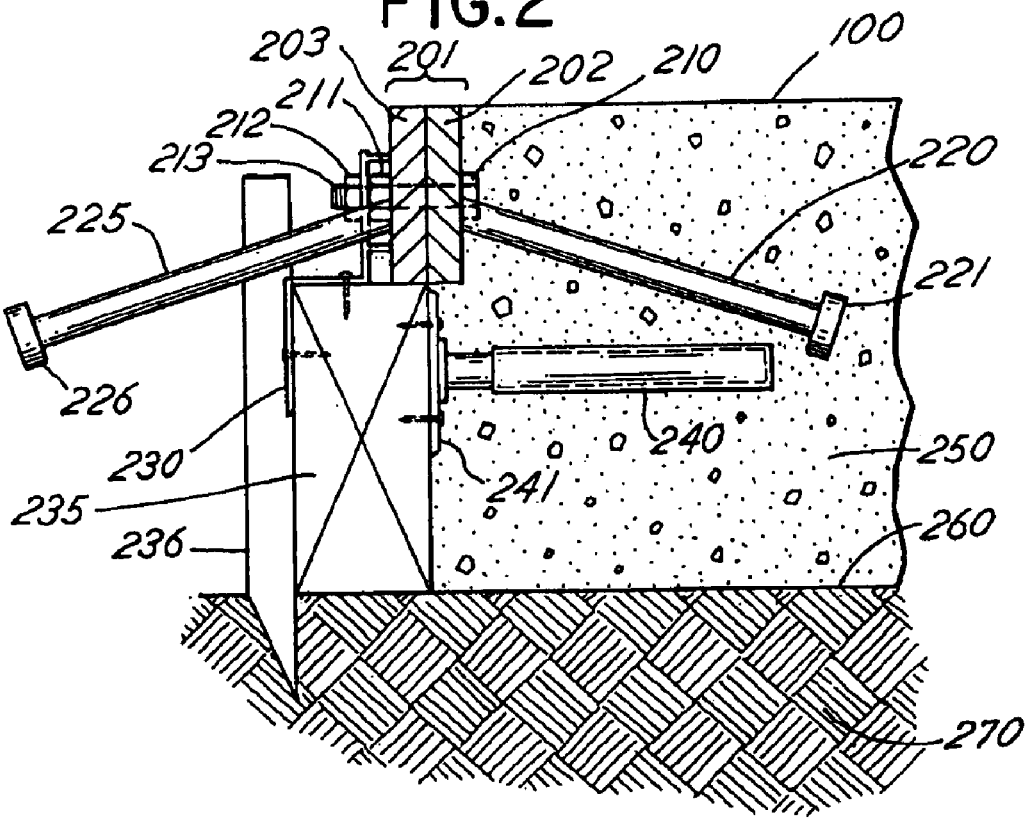
FIG. 2 of the drawing is a cross section view of the joint edge assembly constructed in accordance with the present invention.
Figure 2A:
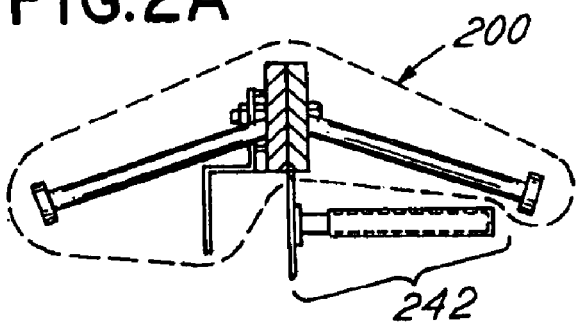
FIG. 2A is a detail of FIG. 2 showing the factory assembled form assembly and the dowel aligner.

A preferred design for a form assembly made in accordance with the claimed invention is shown in FIGS. 1, 2, 2A, 3, and 4. In FIG. 2A, the preferred embodiment of the form assembly 200 is shown. Referring to FIG. 2, the form assembly 200 includes a longitudinal joint rail 201, which is comprised of two joint edge members 202, 203. The joint edge members 202, 203 are typically steel bar sections, but any other suitable steel section, such as an angle section, can be used. FIG. 4 shows the three, dimensional components of the joint rail 201, the longitudinal dimension 401, the major latitudinal dimension 402, and the minor latitudinal dimension 403. In situ, the longitudinal dimension 401 is oriented along the length of the joint 101 between adjacent concrete slab sections 100 (shown in FIG. 1) and parallel to the ground surface 260, which defines a generally flat reference plane. The major latitudinal dimension 402, when in situ, extends generally perpendicular to the reference plane 260 and the minor latitudinal dimension 403, when in situ, extends generally parallel to the reference plane 260. The steel rails, i.e., joint edge members 202, 203, are oriented, when in situ, with the major latitudinal dimensions 402 thereof adjacent to each other.

In the preferred embodiment, holes 410 (shown in FIG. 4) are drilled through the joint rail 201 at longitudinal intervals, so that a connector, typically a bolt, 213 can be passed through the joint rail 201. As shown in FIG. 2, a bolt 213 passes through the holes 410 of the joint rail 201 in a direction generally parallel to the minor latitudinal dimension 403. The bolt 213 is generally permanently affixed to the first joint edge member 202 by any suitable means such as welding the head of the bolt 210 to the first joint edge member 202. The connectors 211, 212 that secure the joint edge members 202, 203 and the mounting bracket 230 are affixed in the reverse order that they are removed. I.e., the shipping/placement connectors 212 are affixed last because they are removed first in the field.

Therefore, the second joint edge member 203 is first secured to the first joint edge member 202 by connectors 211 that will allow the joint edge members 202, 203 to self-release under the force of the concrete slabs 250, 350 shrinking during hardening. The details of the self-release connectors 211 are presented below.

The mounting bracket 230 shown in FIG. 2 is next secured to the joint rail 201 by the shipping/placement connectors 212. The mounting bracket 230 is of any suitable configuration to secure the joint rail 201 to the temporary formwork 235. The temporary formwork 235 is typically comprised of standard 2" lumber sections selected according to the design thickness of the concrete slabs 250, 350. The mounting bracket 230 is designed such that the form assembly 200 can be temporarily affixed to the temporary formwork 235, so that the edge of the temporary formwork 235 aligns with the interface of the first and second joint edge members 202, 203. The shipping/placement connectors 212 are typically comprised of steel, and secure the form assembly from the time of assembly until the temporary formwork 235 is removed in preparation for pouring the adjacent concrete slab 350.

Also shown in FIG. 2 are anchors 220, 225 that are permanently affixed to the joint edge members 202, 203, typically by welding, in order to provide a positive mechanical connection between the concrete slabs 250, 350 and the joint edge members 202, 203. The anchors 220, 225 are typically comprised of headed steel studs. The studs 220, 225 and heads of the steel studs 221, 226 extend downward and outward from the joint rail 201 such that when the concrete slabs 250, 350 are poured, the studs 220, 225 and heads of the steel studs 221, 226 are embedded within the concrete slab. Although a headed stud is preferred, a non-headed stud may be used. Alternatively, the anchor may have ridges or a rough surface to help concrete adhere to the anchor during hardening. As used herein, the term anchor or stud generally includes any structure that projects from the rail assembly to become embedded in the slab, positively connecting the slab to the form assembly.

Ideally, the form assembly 200 shown in FIG. 2A is factory assembled to exacting tolerances. This improves the levelness across joints 101, and makes the finishing of the adjacent concrete slabs easier.

To use the assembly, the factory assembled form assembly 200 is secured to the temporary formwork 235 in the field by any suitable means. The temporary formwork is aligned and fixed in position with stakes 236 or any other suitable member. As in any concrete slab construction, the alignment of the formwork is essential to insuring the desired finished product. One or more dowel aligners 242 (see FIG. 2A) may be integrated into the form assembly to permit dowels 340 (see FIG. 3) to be accurately positioned within the adjacent concrete slab sections. Each dowel aligner 242 comprises a dowel sleeve 240 and a dowel support member 241 attached to the temporary formwork 235. The dowel sleeve permits a dowel 340 to be installed parallel to the minor latitudinal dimension 403 after the first concrete slab 250 has begun to harden and the temporary formwork 235 is removed. Alternatively, a base and sleeve may be used where a load plate is employed between adjacent slabs rather than dowels. As used herein, the dowels generally include any structure that projects from one concrete slab to an adjacent concrete slab, positively connecting the two slabs.

Once the form assembly 200 is properly secured and aligned, the first concrete slab 250 is poured. The studs 220 extending from the first joint edge member 202 become embedded in the wet concrete, and provide a positive mechanical connection between the concrete slab 250 and the joint edge member 202 when the concrete hardens. Once the concrete slab 250 has hardened sufficiently, the shipping/placement connectors 212 are removed followed by the stakes 236, the mounting brackets 230, the temporary formwork 235, and the dowel support members 241. After positioning the dowels 340 in the dowel sleeves 240, the adjacent concrete slab 350 is poured and finished such that the studs 225 and heads of the steel studs 226 extending from the second joint edge member 203 become embedded in the wet concrete of the adjacent concrete slab 350.

As the chemical reaction between the cement and the water in the adjacent concrete slab 350 occurs, i.e., hydration, the concrete hardens and shrinks. This chemical reaction is ongoing in the first concrete slab 250 also, as the process continues for an extended period of time. As the slabs 250, 350 shrink away from one another, the self-release elements in the connectors 211 allow the elongated joint edge members 202, 203 to separate from one another. If desired, the gap formed by the separated joint edge members 202, 203 can be filled with an appropriate sealant.

In the preferred embodiment, the connectors 211 that allow the joint edge members 202, 203 to self-release under the force of the concrete slabs 250, 350 shrinking during hardening are comprised of nylon nuts or other suitable material. The nylon nuts are suitably chosen according to the design tensile strength of the concrete such that the nylon nut yields under the shrinkage stress. Note that the design tensile strength is variable according to the conditions and application of the concrete slabs 250, 350. As the concrete slabs 250, 350 shrink, the studs 220, 225, which are embedded in the concrete slabs 250, 350 pull the joint edge members 202, 203 apart. In the properly compatible design configuration, the nylon nut yields under the shrinkage stress of the concrete, and is stripped off the bolt 213, i.e., the threads of the nylon nuts are sheared as the joint edge members 202, 203 separate.

While in the foregoing, there have been described various preferred embodiments of the present invention, it should be understood to those skilled in the art that various modifications and changes can be made without departing from the scope of the invention as recited in the claims. An effort has been made to prepare claims commensurate in scope with this description without any failure to claim any described embodiment and within the best abilities of the inventors to foresee any modifications or changes.

We claim:

1. An improved joint edge assembly for the construction of jointed concrete slabs and protection of concrete slab joints, the concrete slabs shrinking during hardening, the assembly comprising:

a first elongated joint edge member;

a second elongated joint edge member;

connectors that connect the joint edge members to each other, said connectors also including release elements that release the joint edge members from each other under the force of the slabs shrinking during hardening;

temporary formwork and formwork mounting members;

whereby the assembly of the joint edge members and connectors may be placed for the joint edge members to form and thereby protect edges of a concrete slab joint, whereby the slabs may be poured, and the joint edge members may release from each other under action of the slabs shrinking after pouring, to allow the joint formed by the joint edge members to open and minimize slab cracking at and adjacent the joint during shrinkage, and whereby the formwork mounting members may be mounted on the temporary formwork and may support the assemble in position for the joint edge members to form the edges of the concrete slab.

2. The apparatus of claim 1 further comprising a dowel aligner connected to the temporary formwork, extending into the region where the first concrete slab is to be poured, whereby the dowel aligner permits the placement of dowels prior to the pouring of the adjacent concrete slab.

3. An improved joint edge assembly as in claim 1 further comprising a plurality of anchors extending from each side of the joint edge assembly into the regions where the adjacent slabs are to be poured.

4. An improved joint edge assembly as in claim 3, wherein the plurality of anchors are comprised of at least one steel stud with an expanded head.

5. An improved form assembly for use in the construction of concrete slabs and protection of joints in said concrete slabs after construction, the assembly placed on a ground surface defining a generally flat reference plane, the assembly comprising: a longitudinal joint rail, the longitudinal joint rail comprising a first steel bar and a second steel bar, the steel bars formed of cold rolled steel bar sections and each having a major latitudinal dimension and a minor latitudinal dimension, the major latitudinal dimension, when in situ, extending generally perpendicular to the reference plane and the minor latitudinal dimension, when in situ, extending generally parallel to the reference plane, the steel rails being oriented, when in situ, with the major latitudinal dimensions thereof adjacent each other;

connectors that connect the joint rails in contact with one another, said connectors also including release elements that release the joint edge members from each other under the force of the slabs shrinking during hardening thereby forming releasable joint therebetween;

a temporary formwork along the joint rail and supporting the joint rail above the ground surface;

a plurality of mounting brackets connecting the joint rail to the temporary formwork, the mounting brackets secured to the formwork and secured to the joint rail; and a plurality of studs extending from each side of the form assembly into the regions where the adjacent slabs are to be poured.

6. The apparatus of claim 5, wherein the connectors that connect the joint rails are comprised of at least one steel nut.

7. The apparatus of claim 5, wherein the release element of the connector that connects the joint rails is comprised of at least one nylon nut.

8. The apparatus of claim 5, wherein the longitudinal joint rail is comprised of a first steel angle member and a second steel angle member, the angle members each having a first angle flange and a second angle flange, the first angle flanges of the angle members, when in situ, extending generally perpendicular to the reference plane and the second angle flanges of the angle members, when in situ, extending generally parallel to the reference plane, the angle members being oriented, when in situ, with the first angel flanges thereof adjacent each other.

9. The apparatus of claim 5, wherein the temporary formwork is comprised of wood.

10. The apparatus of claim 9, wherein the temporary formwork is a standard 2" lumber section with a thickness chosen according to the desired concrete slab thickness.

11. The apparatus of claim 5, wherein the temporary formwork is comprised of steel.

12. The apparatus of claim 5, wherein at least one of the studs has an expanded head.

13. The apparatus of claim 5, further comprising a dowel aligner connected to the temporary formwork, extending into the region where the first concrete slab is to be poured, whereby the dowel aligner permits the placement of dowels prior to the pouring of the adjacent concrete slab.

14. The apparatus of claim 13, wherein the dowel aligner is a base and a sleeve adapted to receive a load plate.

15. A method of forming an improved joint edge utilizing an improved joint edge assembly, for the construction of jointed concrete slabs and protection of concrete slab joints, the concrete slabs shrinking after pouring, the assembly comprising a first elongated joint edge member, a second elongated joint edge member, a plurality of anchors extending from each side of the form assembly into the regions where the adjacent slabs are to be poured, connectors that connect the joint edge members to each other, said connectors also including release elements that release the joint edge members from each other under action of the slabs shrinking during hardening, and a dowel aligner connected to temporary formwork, extending into the region where the first concrete slab is to be poured, whereby the dowel aligner permits the placement of dowels prior to the pouring of the adjacent concrete slab, the method comprising:

placing the assembly of the joint edge members and connecting means for the joint edge members to form and thereby protect edges of a concrete slab joint, pouring the slabs to the joint edge members, and allowing the joint edge members to release from each other under action of the slabs shrinking during hardening with the anchors embedded therein and under action of the releasing elements of the connectors, allowing the joint formed by the joint edge members to open and minimize slab cracking at and adjacent to the joint during shrinkage and subsequently protecting the joint edge.

16. An article made according to the method of claim 15.

* * * * *

UNITED STATES PATENT AND TRADEMARK OFFICE

CERTIFICATE OF CORRECTION

PATENT NO. : 6,775,952 B2
APPLICATION NO. : 10/210464
DATED : August 17, 2004
INVENTOR(S) : Boxall et al.

It is certified that error appears in the above-identified patent and that said Letters Patent is hereby corrected as shown below:

On title page
Please delete Item [73] Assignee:

Signed and Sealed this

Seventh Day of August, 2007

JON W. DUDAS
*Director of the United States Patent and Trademark Office*